US008851956B2

(12) United States Patent
Niu

(10) Patent No.: US 8,851,956 B2
(45) Date of Patent: Oct. 7, 2014

(54) PLAYHOUSE

(71) Applicant: D.J. Toys Enterprise Corp., Taichung (TW)

(72) Inventor: Li-Yang Niu, Taichung (TW)

(73) Assignee: D.J. Toys Enterprise Corp., Taichung (TW)

( * ) Notice: Subject to any disclaimer, the term of this patent is extended or adjusted under 35 U.S.C. 154(b) by 50 days.

(21) Appl. No.: 13/691,899

(22) Filed: Dec. 3, 2012

(65) Prior Publication Data

US 2014/0155183 A1 Jun. 5, 2014

(51) Int. Cl.
*A63H 3/52* (2006.01)
*E04H 15/00* (2006.01)
*A63H 3/00* (2006.01)

(52) U.S. Cl.
CPC ..... *E04H 15/006* (2013.01)
USPC ..... 446/476; 446/478; 135/125

(58) Field of Classification Search
USPC ..... 446/476, 478, 486, 487; 135/87, 125, 135/126, 137
See application file for complete search history.

(56) References Cited

U.S. PATENT DOCUMENTS

| | | | | |
|---|---|---|---|---|
| 3,039,478 | A * | 6/1962 | Timmons | 135/137 |
| 3,625,235 | A * | 12/1971 | Gorgichuk | 135/87 |
| 4,811,751 | A * | 3/1989 | Maloney, II | 135/125 |
| 5,301,706 | A * | 4/1994 | Jones | 135/125 |
| 6,453,923 | B2 * | 9/2002 | Zheng | 135/126 |
| 6,502,596 | B1 * | 1/2003 | Danaher | 135/126 |
| 6,892,742 | B2 * | 5/2005 | Wang | 135/125 |

* cited by examiner

*Primary Examiner* — Kien Nguyen
(74) *Attorney, Agent, or Firm* — Alan Kamrath; Kamrath IP Lawfirm, P.A.

(57) ABSTRACT

A playhouse has a main frame, a canopy mounted on and above the main frame, and two roof supporting frames. When the roof supporting frames cross each other, the canopy is propped up and expanded to construct the playhouse into a three-dimensional space. Thus, the playhouse does not collapse while children are bumping into the playhouse and is safe for use. When folding the playhouse, the roof supporting frames are inclined to overlap the main frame. Thus, the main frame and the roof supporting frames can be twisted into a figure of an "8" and then folded into a small size to reduce space that the playhouse occupies in storage.

15 Claims, 15 Drawing Sheets

PLAYHOUSE

BACKGROUND OF THE INVENTION

1. Field of the Invention

The present invention relates to a playhouse and, especially, to a playhouse that is easy to be assembled, expanded, folded and stored.

2. Description of the Prior Art(s)

Toys for children provide recreational and educational functions and are helpful in development of the children's personality. Among the toys, playhouses allow the children to build up their personal spaces. Therefore, the playhouses, as secret bases of the children, are helpful in cultivation of the children's independent personality.

A first conventional playhouse is established by multiple panels, such as floor panels, wall panels and roof panels. Some of the wall panels have openings that function as windows or an entrance of the first conventional playhouse. However, since the panels have rigid shapes and thickness, whether in a set-up condition or disassembled into panels, the first conventional playhouse occupies much room and is not suitable for a family having limited household space. Moreover, the rigid panels are very likely to injure the children when the children are assembling or are playing around the first conventional playhouse.

With reference to FIG. 14, a second conventional playhouse is formed like a tent and has four side tent fabrics 91 and two end tent fabrics 92. The side tent fabrics 91 are sequentially connected and arranged into a round shape. Each side tent fabric 91 is rectangular and has a peripheral edge wrapped around a spring wire 93. One end tent fabric 92 is mounted on bottoms of the side tent fabrics 91 to form a floor of the conventional playhouse. The other end tent fabric 92 is mounted on tops of the side tent fabrics 91 to form a roof of the conventional playhouse. When the spring wires 93 extend, the second conventional playhouse is constructed into a three-dimensional space. When the side tent fabrics 91 overlap, the spring wires 93 can be twisted and bent into a small size for convenience of storage. However, also for convenience of storage, the spring wires 93 are usually thin and soft, which makes the second conventional playhouse have insufficient structural strength. Therefore, when the children play around and bump into the second conventional playhouse, the spring wires 93 deform easily, or the spring wires 93 fracture and protrude out of the side tent fabrics 91 to injure the children.

With reference to FIG. 15, a third conventional playhouse is formed like a tent and has a tent fabric 94 and multiple supporting rods 95. The supporting rods 95 are separately mounted on the tent fabric 94. Each supporting rod 95 has multiple short bars 951 sequentially connected to each other. With the supporting rods 95 expanding the tent fabric 94, the third conventional playhouse is constructed into a three-dimensional space. The third conventional playhouse can be formed into a prism or a cylinder. However, although the supporting rods 95 formed by connecting multiple short bars 951 can be disassembled for convenience of storage and transportation, assembling the short bars 951 into the supporting rods 95 is inconvenient. Furthermore, since the supporting rods 95 are mounted and exposed on the tent fabric 94, the children playing around the third conventional playhouse are very likely to bump into the supporting rods 95, which causes collapse of the short bars 951 of the supporting rods 95 and the third conventional playhouse. Therefore, the third conventional playhouse is not safe for children.

To overcome the shortcomings, the present invention provides a playhouse to mitigate or obviate the aforementioned problems.

SUMMARY OF THE INVENTION

The main objective of the present invention is to provide a playhouse that is easy to be assembled, expanded, folded and stored and does not injure children bumping into the playhouse.

The playhouse has a main frame, a canopy and two roof supporting frames. The main frame has a main spring wire of a circular shape, and a sleeve wrapped around the main spring wire. The canopy is mounted on and above the main frame and has a top tent fabric having an outer peripheral edge connected to the sleeve of the main frame. An area of the top tent fabric is larger than an area surrounded by the main frame. The roof supporting frames are mounted on the main frame. Each roof supporting frame is longer than a diameter of the main frame and has a resilient support of an elongated arc shape, and a sleeve. The sleeve of the roof supporting frame is wrapped around the resilient support, is longer than the resilient support and has two ends connected to the sleeve of the main frame.

When the roof supporting frames cross each other, the canopy is propped up and expanded to construct the playhouse into a three-dimensional space. Thus, the playhouse does not collapse when children bump into the playhouse and is safe for use. When folding the playhouse, the roof supporting frames are inclined to overlap the main frame. Thus, the main frame and the roof supporting frames can be twisted into a figure of an "8" and then folded into a small size to reduce space that the playhouse occupies in storage.

The above-mentioned playhouse may further have a bottom frame, a side tent fabric, a bottom tent fabric and multiple supporting assemblies. The bottom frame is mounted below the main frame, is separate from the main frame and has a bottom spring wire of a circular shape, and a sleeve wrapped around the bottom spring wire. The side tent fabric is mounted between and arranged around the main frame and the bottom frame and has an upper peripheral edge connected to the sleeve of the main frame, and a lower peripheral edge connected to the sleeve of the bottom frame. The bottom tent fabric is mounted in the bottom frame and has an outer peripheral edge connected to the sleeve of the bottom frame. An area of the bottom tent fabric is equal to an area surrounded by the bottom frame. The supporting assemblies are longitudinally mounted separately on and are arranged around the side tent fabric. Each supporting assembly has two side supports and a connector. The side supports are separately arranged longitudinally on the side tent fabric. Each side support has a fixing end securely attached to the side tent fabric, and a connecting end corresponding to the connecting end of the other side support. The connector is disposed between the connecting ends of the side supports and has two slots respectively formed in two opposite ends of the connector. Each slot selectively receives the connecting end of a corresponding side support.

The above-mentioned playhouse may further have an upper tent fabric mounted in the main frame and having an outer peripheral edge connected to the sleeve of the main frame. An area of the upper tent fabric is equal to the area surrounded by the main frame.

The above-mentioned canopy may further have a top spring wire, a covering sheet and a fastener. The top spring wire is mounted on an inner surface of the top tent fabric and is disposed on a center of the top tent fabric. The covering sheet is securely mounted on the inner surface of the top tent fabric and covers the top spring wire. The fastener is mounted on the covering sheet. Each of the above-mentioned roof supporting frame further has a fastener mounted on the sleeve of the roof supporting frame and selectively attached to the fastener of the canopy.

Each of the above-mentioned supporting assemblies may further have at least one extending strip mounted between the side supports. Each of the at least one extending strip has a fixing end securely attached to one side support, and a connecting end extending above and selectively attached to the other side support.

Each of the above-mentioned supporting assemblies may further have multiple pairs of fasteners mounted between the connecting end of the at least one extending strip and the side support that corresponds to the connecting end of the at least one extending strip to connect the at least one extending strip and the side support, and between the side tent fabric and the side supports to connect the side tent fabric and the side supports.

Each of the above-mentioned pairs of fasteners may comprise a hook fastener and a loop fastener.

Each of the above-mentioned side supports may further comprise a supporting bracket being rigid, and a sleeve wrapped around the supporting bracket.

Other objectives, advantages and novel features of the invention will become more apparent from the following detailed description when taken in conjunction with the accompanying drawings.

DETAILED DESCRIPTION OF THE PREFERRED EMBODIMENTS

Figure 1A:
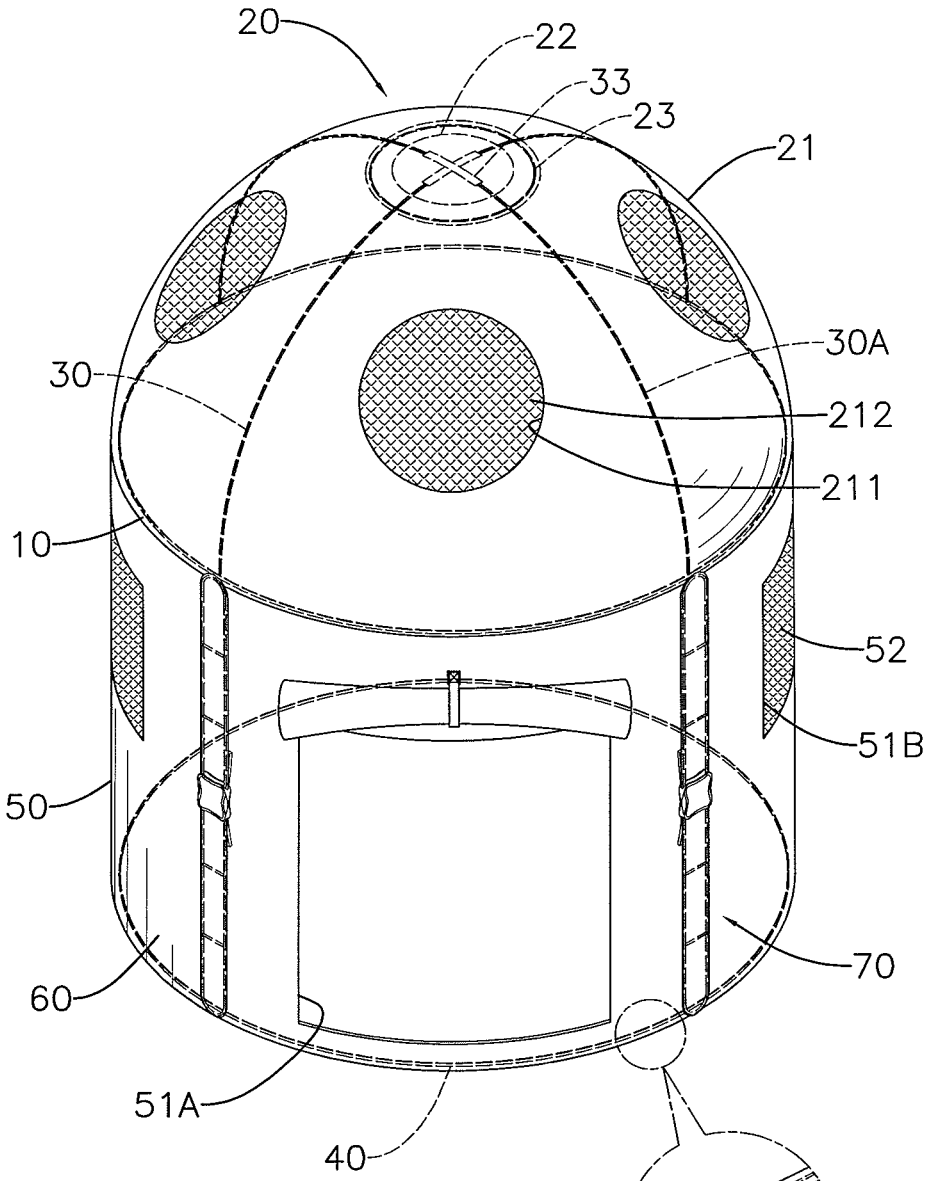
FIG. 1*a* is a perspective view of a playhouse in accordance with the present invention.
Figure 1B:
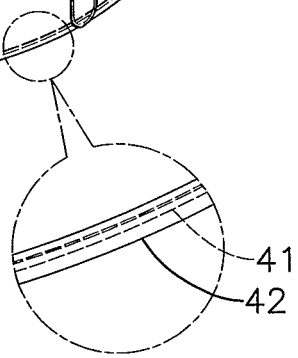
FIG. 1*b* is an enlarged perspective view of a bottom frame of the playhouse in FIG. 1*a;*

With reference to FIGS. 1*a* and 1*b*, a playhouse in accordance with the present invention comprises a main frame 10, a canopy 20, two roof supporting frames 30, 30A, a bottom frame 40, a side tent fabric 50, a bottom tent fabric 60 and multiple supporting assemblies 70.

Figures 2A, 2B:
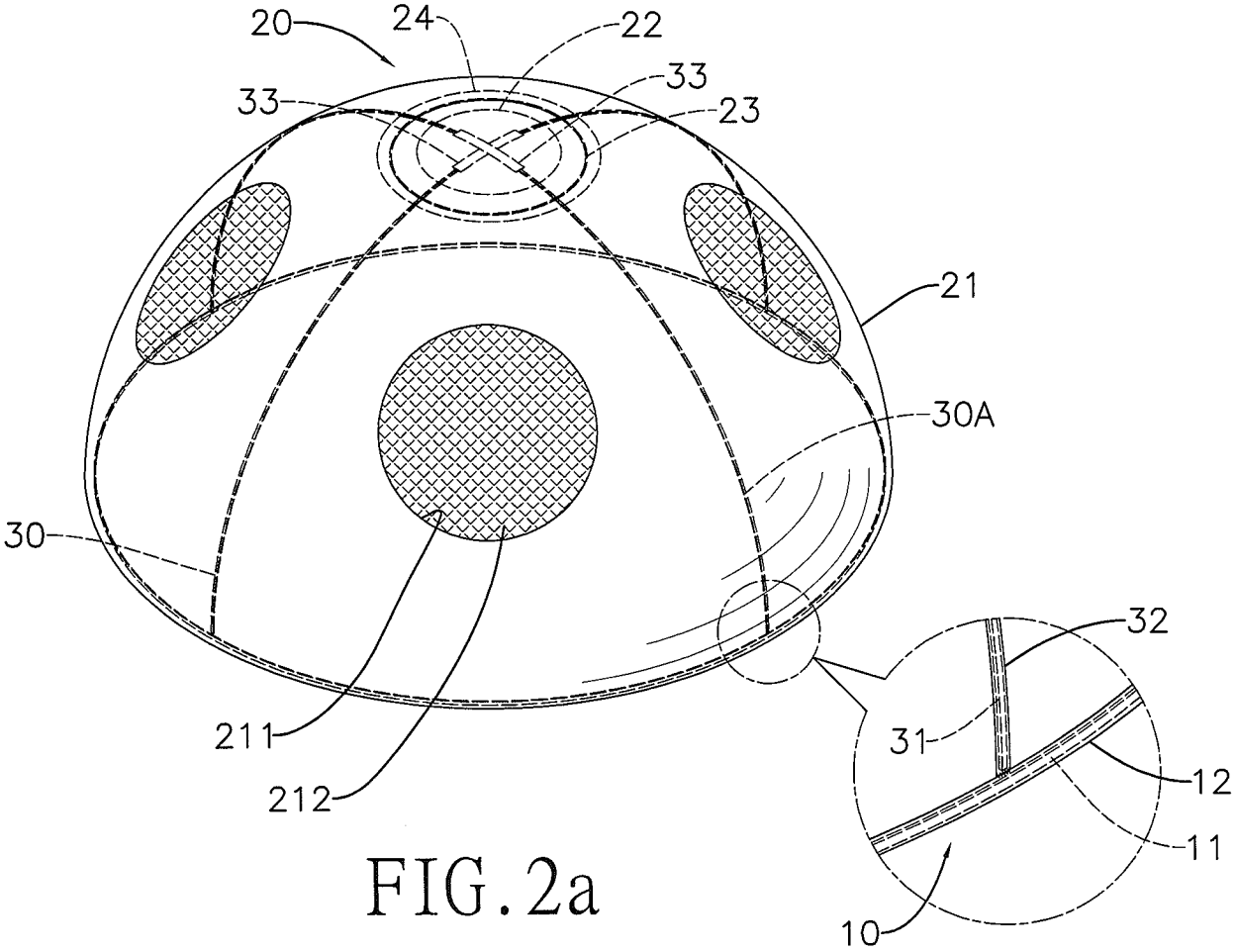
FIG. 2*a* is an enlarged perspective view of a main frame, a canopy and two roof supporting frames of the playhouse in FIG. 1*a;*
FIG. 2*b* is an enlarged perspective view of the main frame and the roof supporting frames of the playhouse in FIG. 2*a;*

With further reference to FIGS. 2*a* and 2*b*, the main frame 10 has a main spring wire 11 and a cloth sleeve 12. The main spring wire 11 is circular. The sleeve 12 of the main frame 10 is wrapped around the main spring wire 11.

Figure 3:
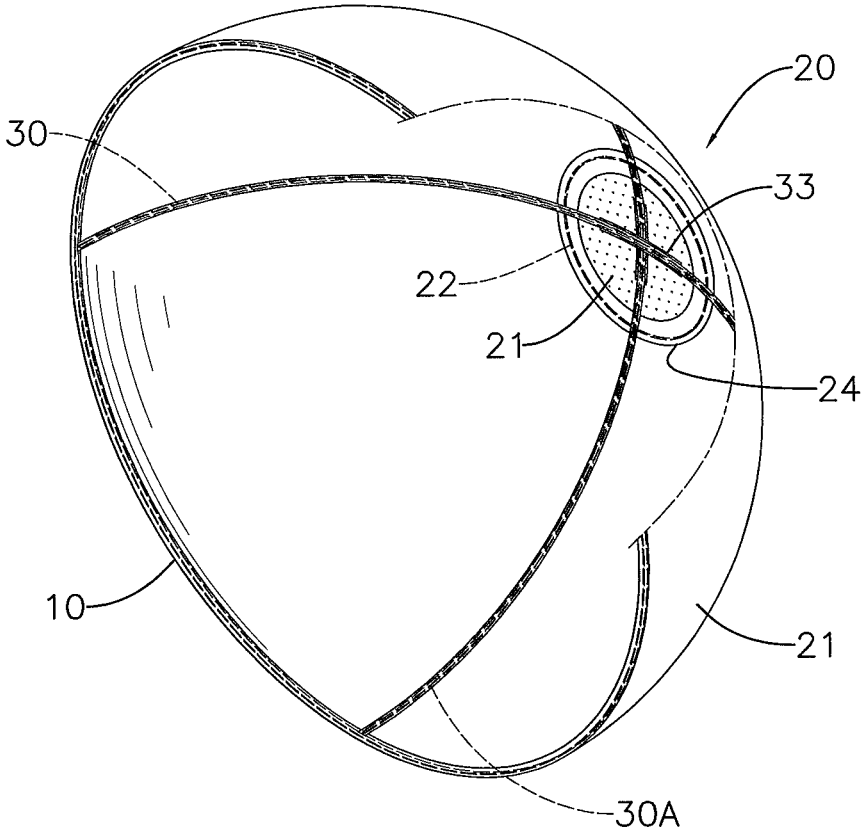
FIG. 3 is a partial bottom perspective view of the main frame, the canopy and the roof supporting frames of the playhouse in FIG. 1*a;*

With further reference to FIG. 3, the canopy 20 is mounted on and above the main frame 10 and has a top tent fabric 21, a top spring wire 23, a covering sheet 24 and a fastener 22. The top tent fabric 21 has an outer peripheral edge, an inner surface, multiple openings 211 and multiple nets 212. The outer peripheral edge of the top tent fabric 21 is connected to the sleeve 12 of the main frame 10. The openings 211 of the top tent fabric 21 are separately formed through the top tent fabric 21 and serve as windows of the playhouse. The nets 212 of the top tent fabric 21 are respectively mounted in the openings 211 of the top tent fabric 21. An area of the top tent fabric 21 is larger than an surrounded by the main frame 10. Thus, the top tent fabric 21 can be expanded like a dome. The top spring wire 23 is mounted on the inner surface of the top tent fabric 21 and is disposed on a center of the top tent fabric 21. The covering sheet 24 is securely mounted on the inner surface of the top tent fabric 21 and covers the top spring wire 23. Thus, the top spring wire 23 is held between the top tent fabric 21 and the covering sheet 24, the center of the top tent fabric 21 is structurally reinforced, and the top tent fabric 21 has smooth curvatures when being expanded. The fastener 22 of the canopy 20 is mounted on the covering sheet 24.

The roof supporting frames 30, 30A are mounted on the main frame 10. Each roof supporting frame 30, 30A is longer than a diameter of the main frame 10, and has a resilient support 31, a cloth sleeve 32 and a fastener 33. The resilient support 31 is an elongated arc. The sleeve 32 of the roof supporting frame 30, 30A is wrapped around the resilient support 31, is longer than the resilient support 31 and has two ends connected to the sleeve 12 of the main frame 10. The fastener 33 of the roof supporting frame 30, 30A is mounted on the sleeve 32 of the roof supporting frame 30, 30A and is selectively attached to the fastener 22 of the canopy 20 to prop up the top tent fabric 21 into the dome.

The bottom frame 40 is mounted below the main frame 10, is separate from the main frame 10, and has a bottom spring wire 41 and a cloth sleeve 42. The bottom spring wire 41 is circular. The sleeve 42 of the bottom frame 40 is wrapped around the bottom spring wire 41.

The side tent fabric 50 is mounted between and is arranged around the main frame 10 and the bottom frame 40, and has an upper peripheral edge, a lower peripheral edge, multiple openings 51A, 51B and multiple nets 52. The upper peripheral edge of the side tent fabric 50 is connected to the sleeve 12 of the main frame 10. The lower peripheral edge of the side tent fabric 50 is connected to the sleeve 42 of the bottom frame 40. The openings 51A, 51B of the side tent fabric 50 are separately formed through the side tent fabric 50. The nets 52 of the side tent fabric 50 are mounted in the openings 51B of the side tent fabric 50. One opening 51A of the side tent fabric 50 without the nets 52 mounted therein serves as an entrance of the playhouse, and the other openings 51B of the side tent fabric 50 with the nets 52 mounted therein serve as windows of the playhouse.

The bottom tent fabric 60 is mounted in the bottom frame 40 and has an outer peripheral edge connected to the sleeve 42 of the bottom frame 40. An area of the bottom tent fabric 60 is substantially equal to an area surrounded by the bottom frame 40. Thus, the bottom tent fabric 60 could be a floor of the playhouse.

Figure 9:
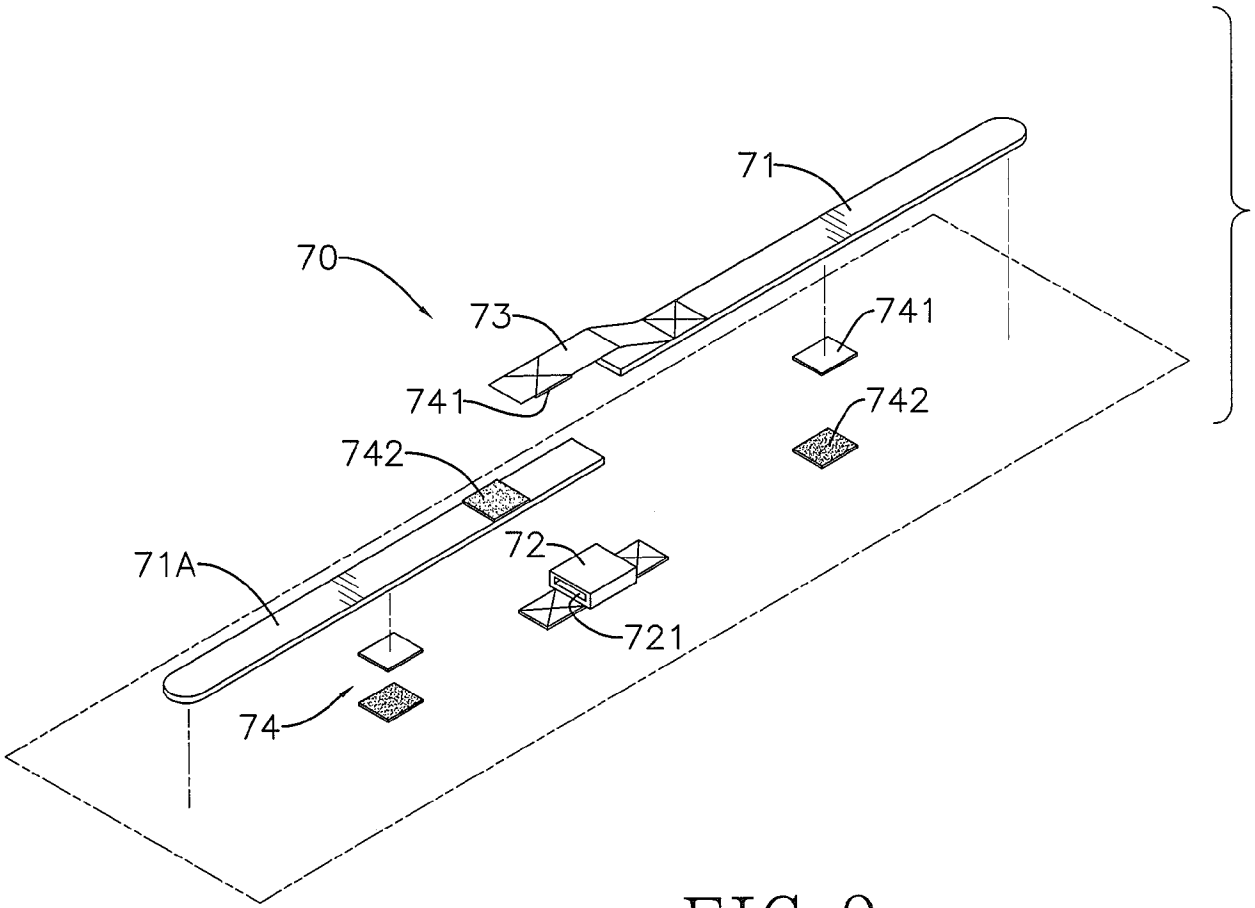
FIG. 9 is an exploded perspective view of the supporting assembly of the playhouse in FIG. 1*a;*

With further reference to FIG. 9, the supporting assemblies 70 are longitudinally mounted separately on and are arranged around the side tent fabric 50. Each supporting assembly 70 has two side supports 71, 71A, a connector 72, at least one extending strip 73 and multiple pairs of fasteners 74.

Figure 10:
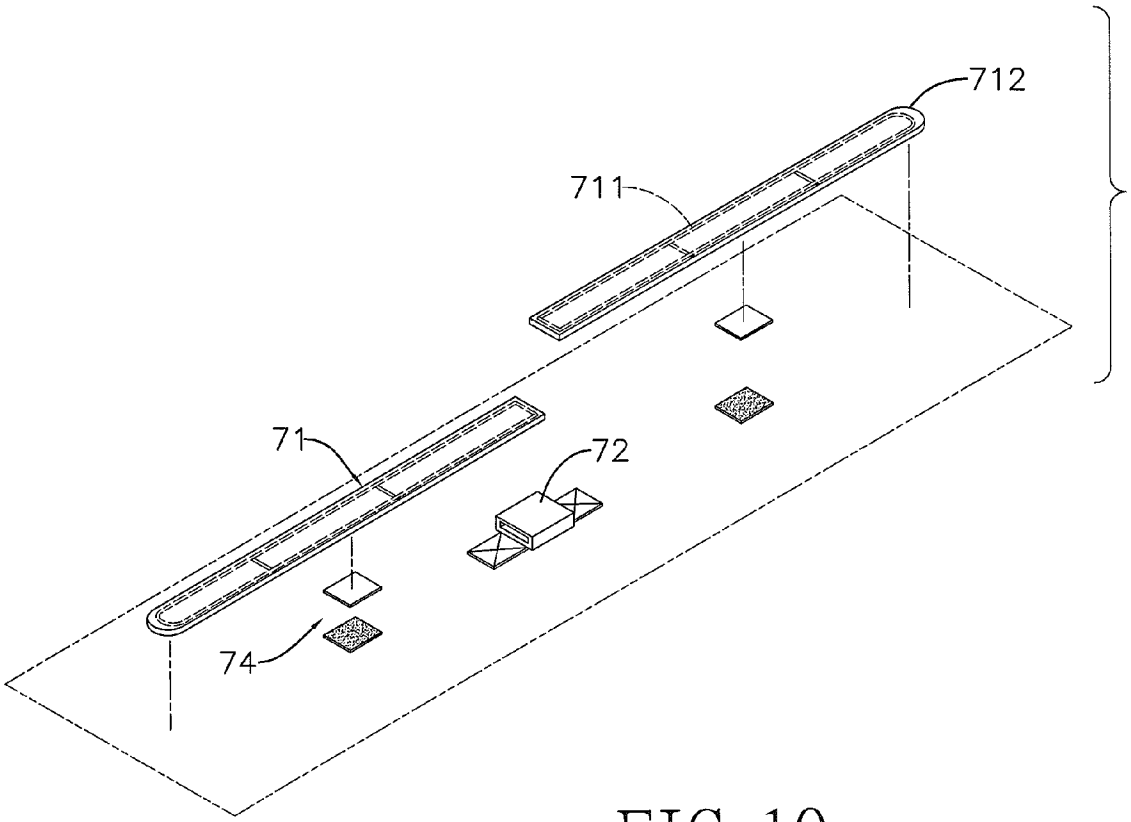
FIG. 10 is another exploded perspective view of the supporting assembly of the playhouse in FIG. 1*a;*

With further reference to FIG. 10, the side supports 71, 71A are separately arranged longitudinally on the side tent fabric 50. Each side support 71, 71A has a fixing end, a connecting end, a supporting bracket 711 and a cloth sleeve 712. The fixing end of the side support 71, 71A is securely attached to the side tent fabric 50. The connecting end of the side support 71, 71A corresponds to the connecting end of the other side support 71, 71A. The supporting bracket 711 may be made of metal or reinforced plastic and is rigid. The sleeve 712 of the side support 71, 71A is wrapped around the supporting bracket 711. Thus, the side supports 71, 71A are hard inside and tender outside and do not injure children playing around the playhouse.

The connector 72 may be made of metal or reinforced plastic, is securely mounted on the side tent fabric 50, is disposed between the connecting ends of the side supports 71, 71A, and has two opposite ends and two slots 721. The ends of the connector 72 respectively correspond to the connecting ends of the side supports 71, 71A. The slots 721 are respectively formed in the ends of the connector 72. Each slot 721 selectively receives the connecting end of a corresponding side support 71, 71A. Thus, the connecting ends of the side supports 71, 71A as well as the side supports 71, 71A are held in specific positions.

The at least one extending strip 73 is mounted between the side supports 71, 71A. Each of the at least one extending strip 73 has a fixing end and a connecting end. The fixing end of the extending strip 73 is securely attached to one side support 71, 71A. The connecting end of the extending strip 73 extends above and is selectively attached to the other side support 71, 71A.

The pairs of fasteners 74 are mounted between the connecting end of the at least one extending strip 73 and the side support 71A that corresponds to the connecting end of the at least one extending strip 73 to connect the at least one extending strip 73 and the side support 71A, and between the side tent fabric 50 and the side supports 71, 71A to connect the side tent fabric 50 and the side supports 71, 71A. Preferably, each pair of fasteners 74 comprises a hook fastener 741 and a loop fastener 742. The at least one extending strip 73 and the side tent fabric 50 are connected to the side supports 71, 71A via the loop fasteners 741 and the loop fasteners 742.

Figure 4:
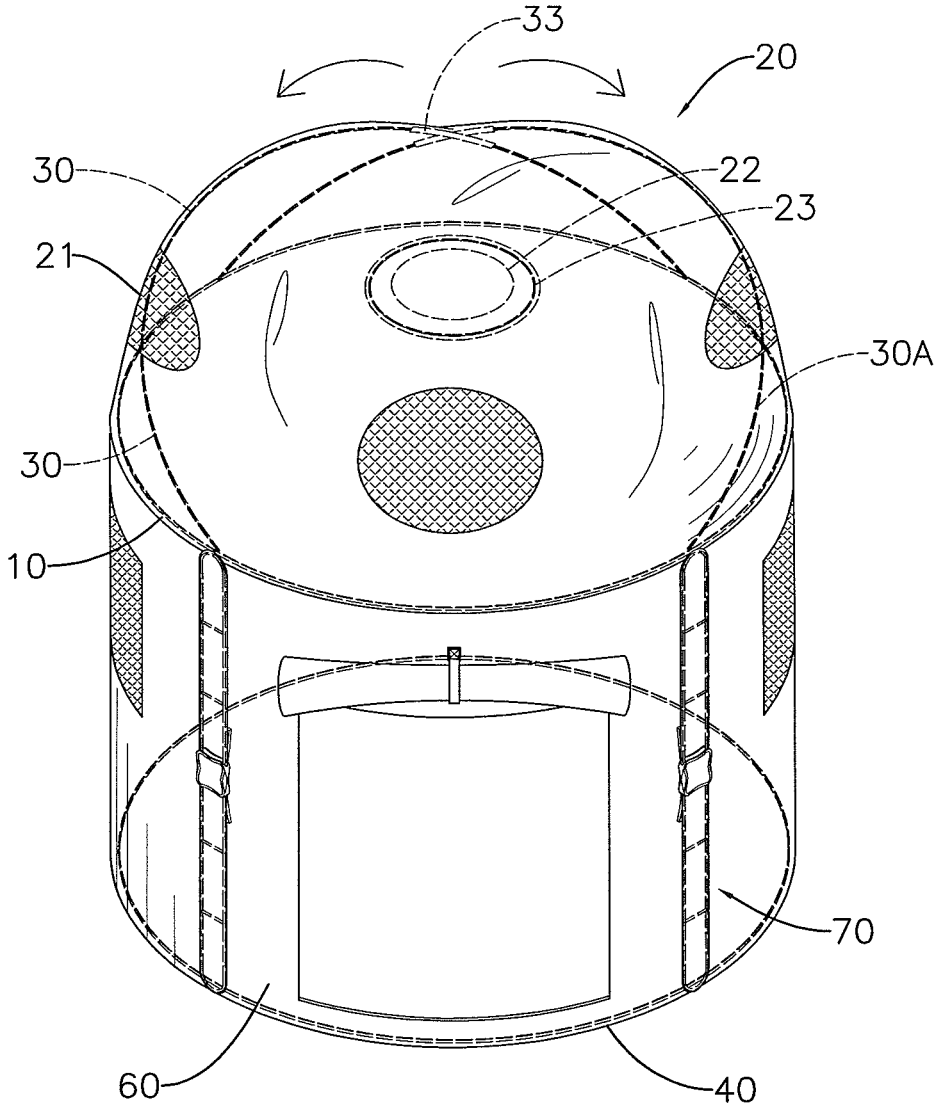
FIG. 4 is an operational perspective view of the playhouse in FIG. 1*a*, showing the roof supporting frames are inclined aside.
Figure 5:
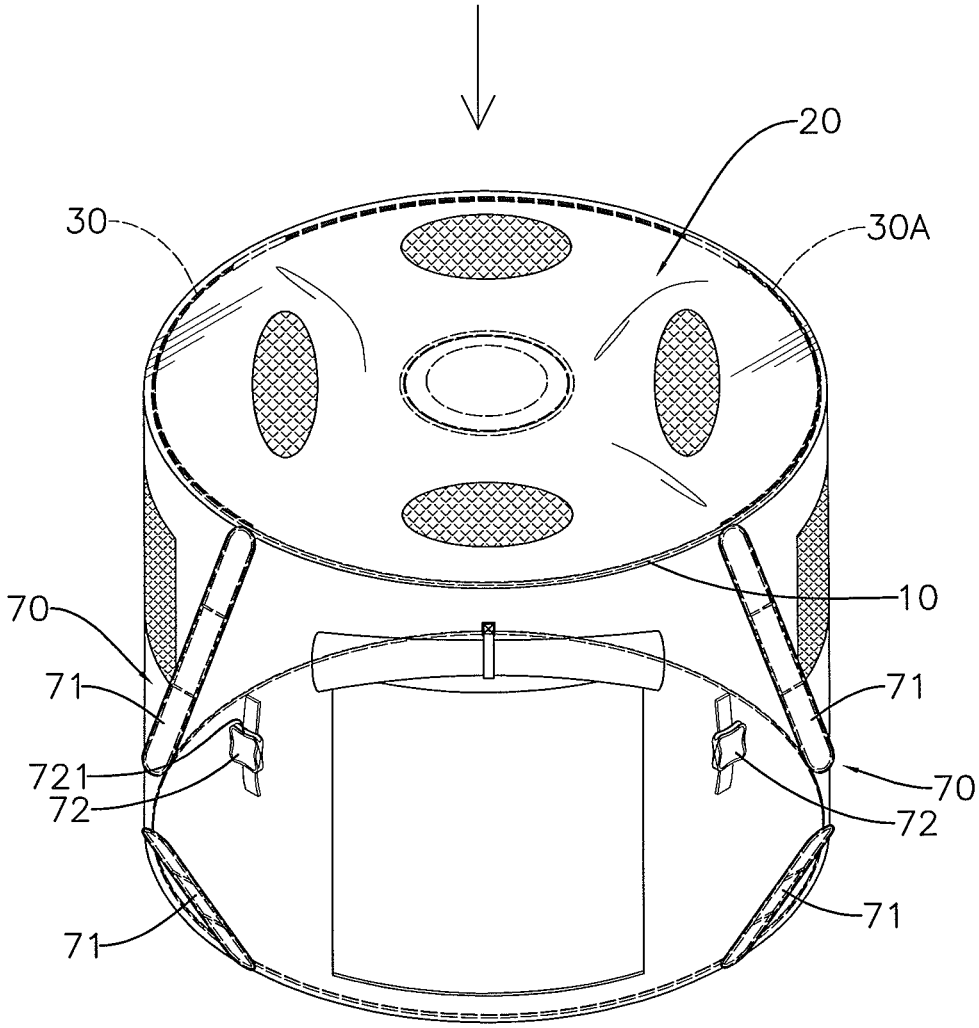
FIG. 5 is an operational perspective view of the playhouse in FIG. 1*a*, showing multiple supporting assemblies are disassembled.
Figure 6:
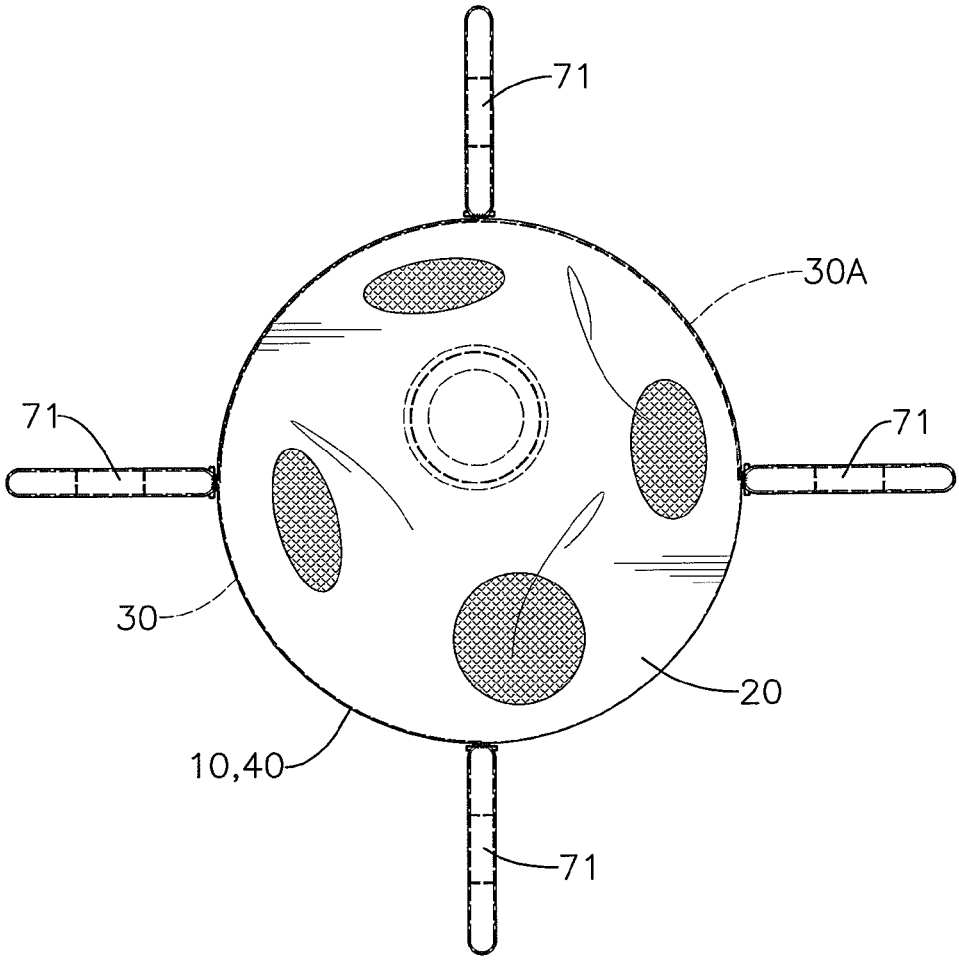
FIG. 6 is an operational top view of the playhouse in FIG. 1*a*, showing the supporting assemblies are disassembled.
Figure 7:
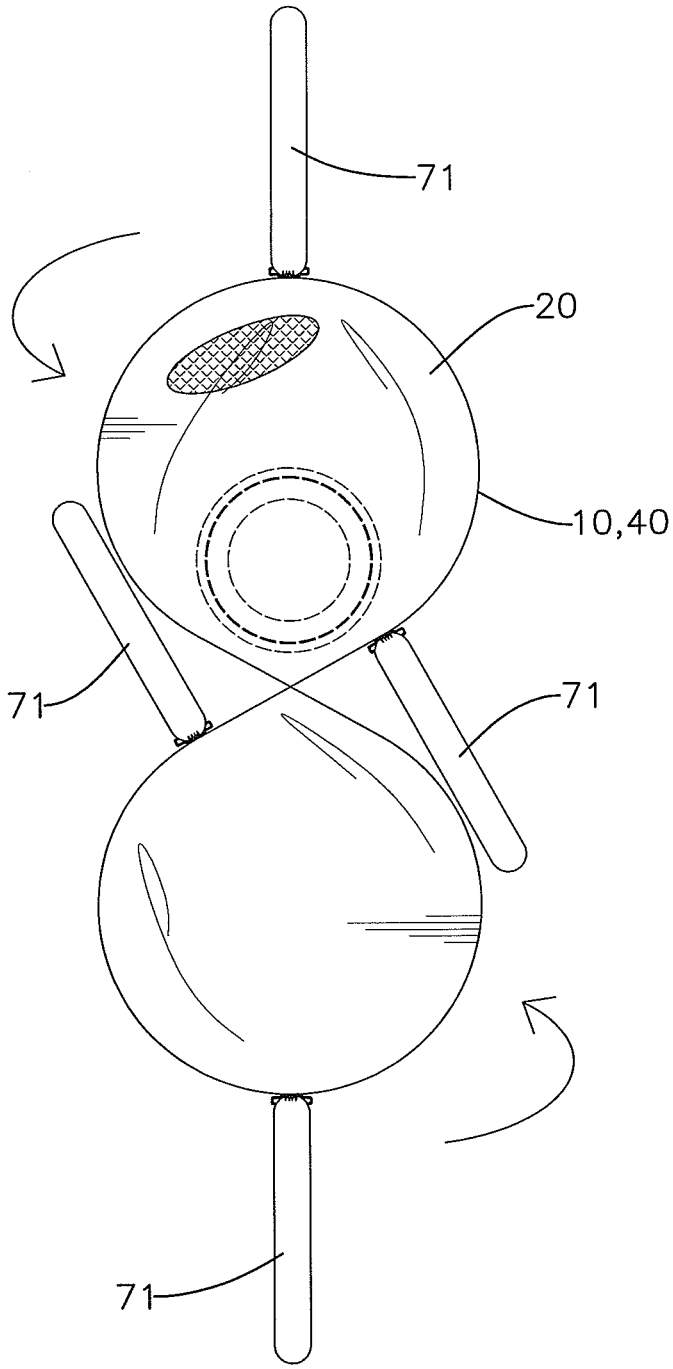
FIG. 7 is an operational top view of the playhouse in FIG. 1*a*, showing the playhouse is twisted.
Figure 8:
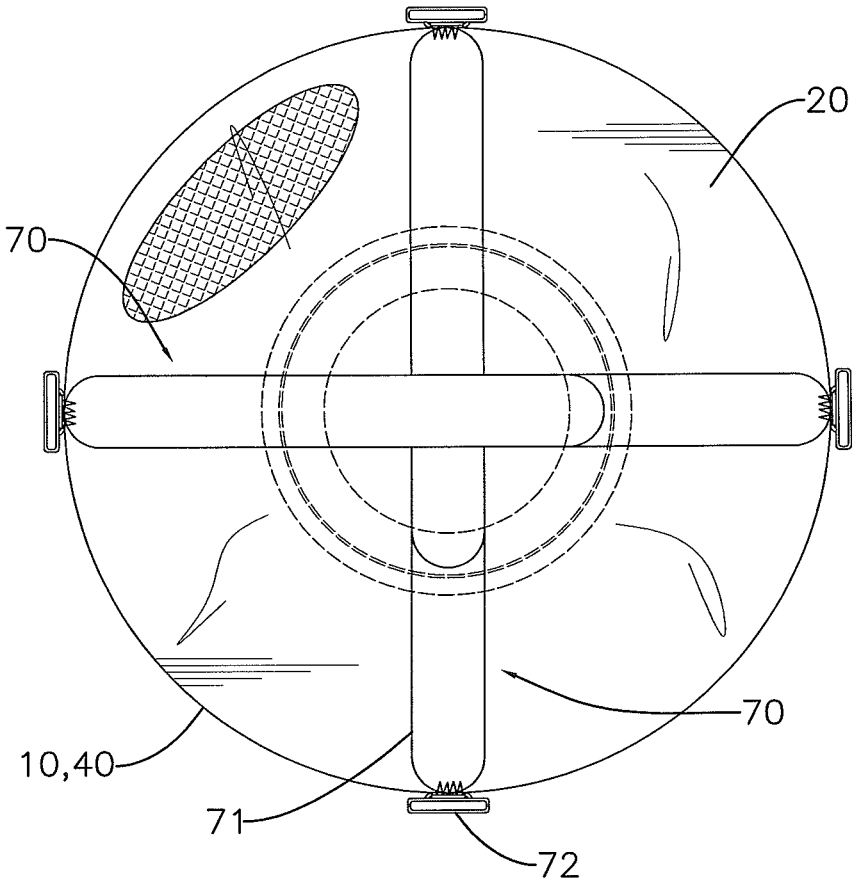
FIG. 8 is an operational top view of the playhouse in FIG. 1*a*, showing the playhouse is folded.

Furthermore, with further reference to FIG. 4, when folding the playhouse, the roof supporting frames 30, 30A are inclined to overlap the main frame 10 first. With further reference to FIG. 5, the side supports 71, 71A and the connector 72 of the supporting assemblies 70 are disassembled, so the main frame 10 and the roof supporting frames 30, 30A further overlap the bottom frame 40. With further reference to FIGS. 7, 8, the main frame 10, the roof supporting frames 30, 30A and the bottom frame 40 can be twisted in a figure of an "8" and then folded into a small size to reduce space that the playhouse occupies in storage.

Figure 11:
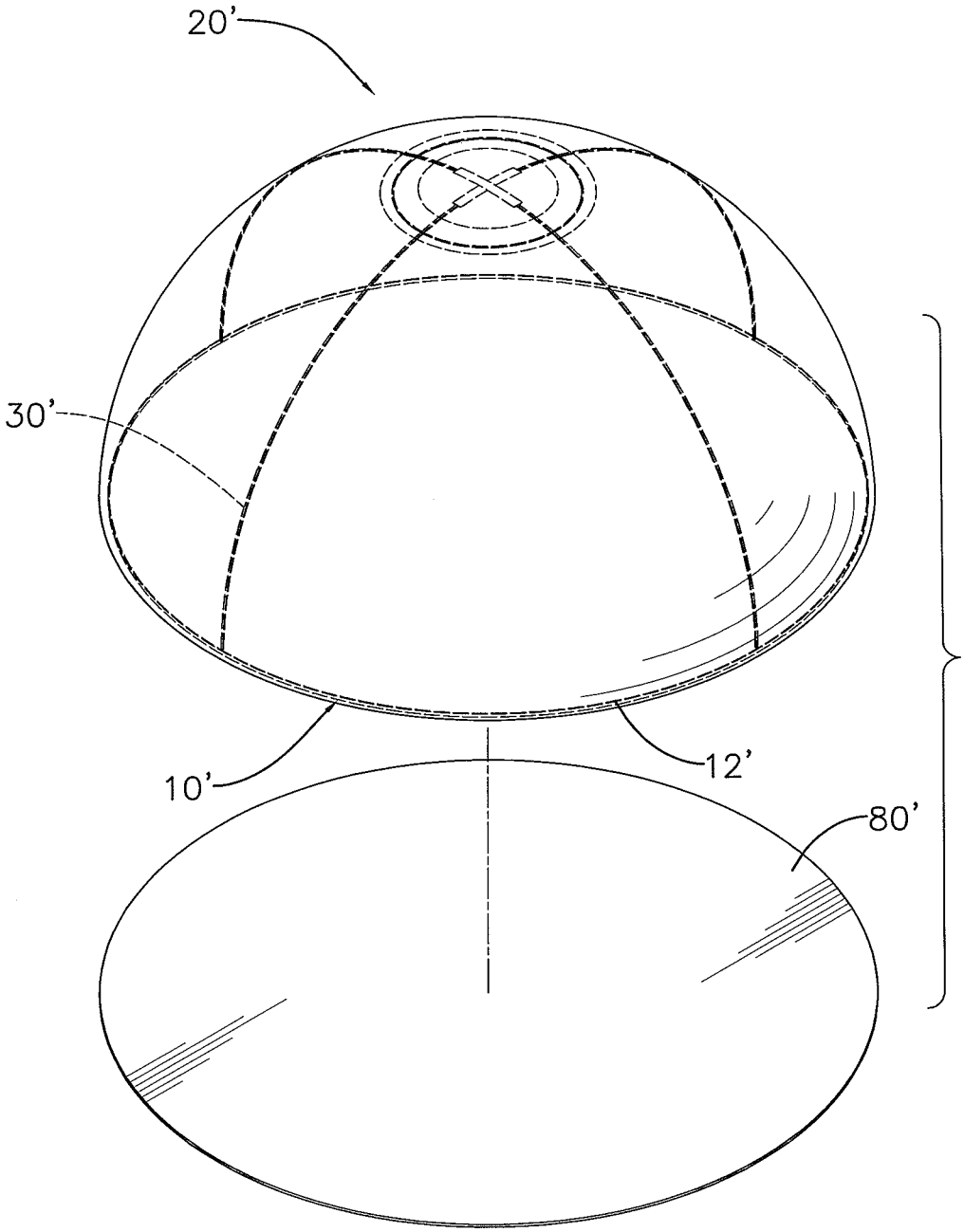
FIG. 11 is a perspective view of another embodiment of a playhouse in accordance with the present invention.
Figure 12:
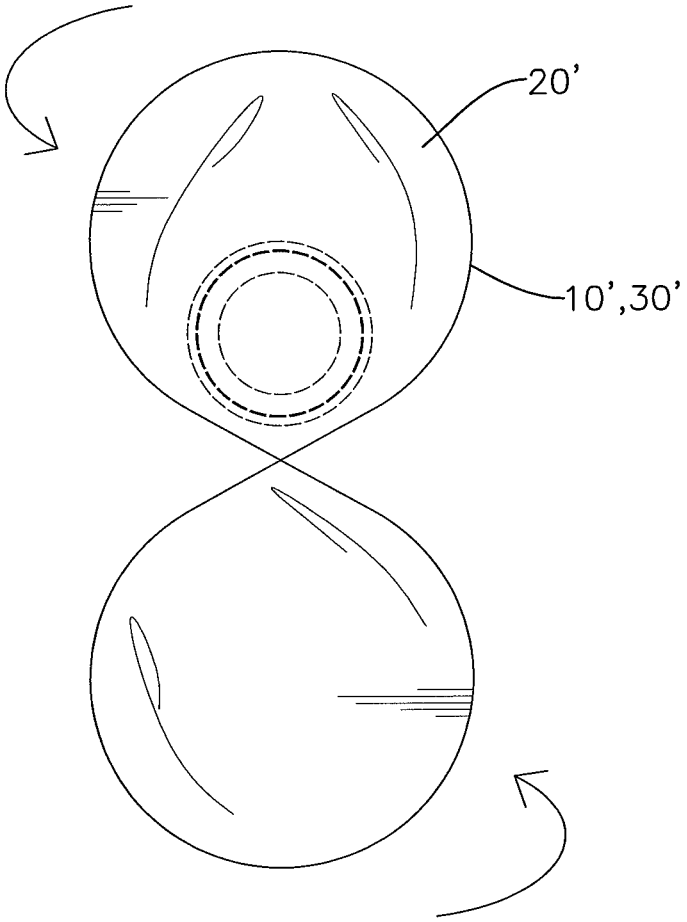
FIG. 12 is an operational top view of the playhouse in FIG. 11, showing the playhouse is twisted.
Figure 13:
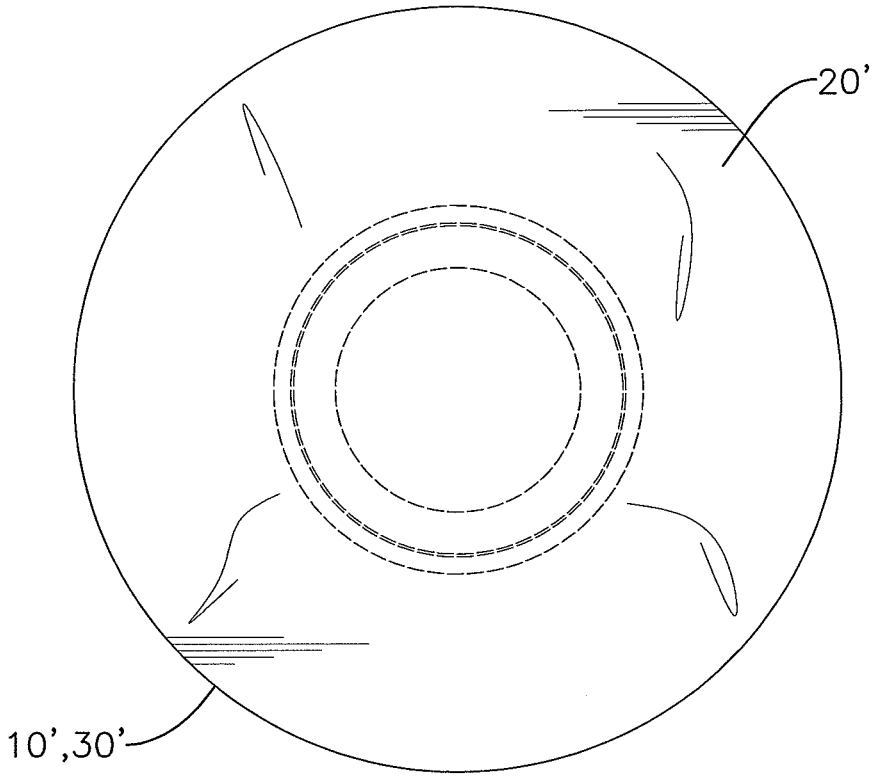
FIG. 13 is an operational top view of the playhouse in FIG. 11, showing the playhouse is folded.
Figure 14:
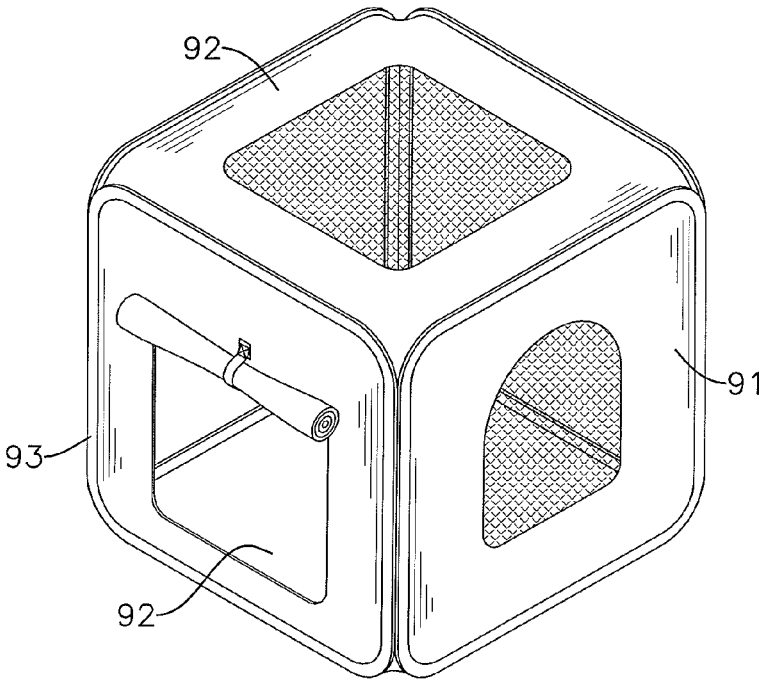
FIG. 14 PRIOR ART
FIG. 14 is a perspective view of a conventional playhouse in accordance with the prior art.
Figure 15:
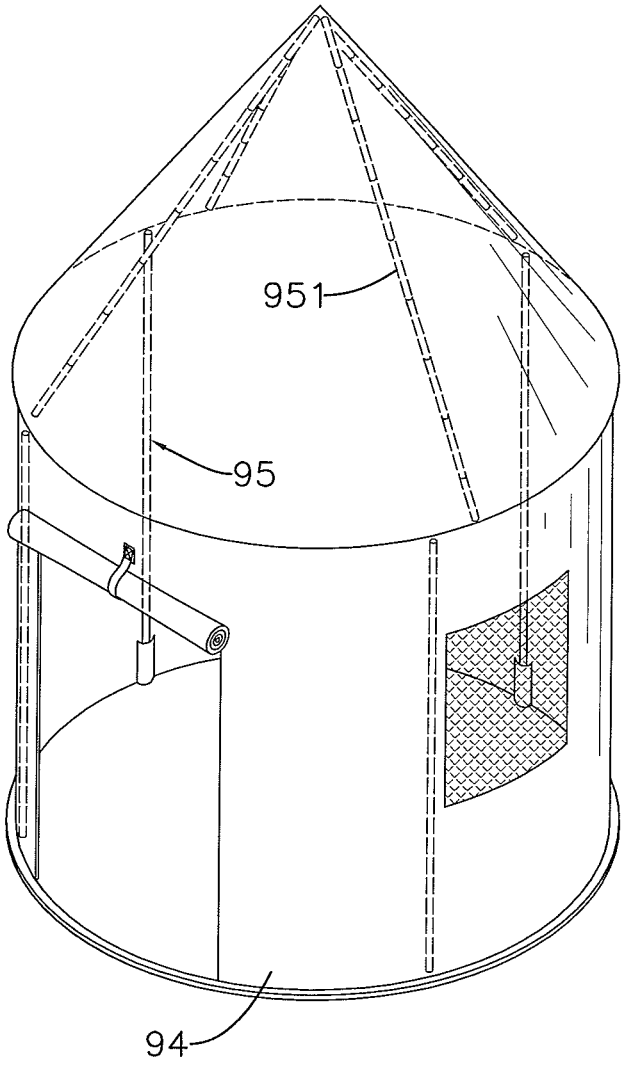
FIG. 15 PRIOR ART
FIG. 15 is a perspective view of another conventional playhouse in accordance with the prior art.

With further reference to FIG. 11, another preferred embodiment of the playhouse in accordance with the present invention comprises a main frame 10', a canopy 20' and two roof supporting frames 30' as described and further comprises an upper tent fabric 80'. The upper tent fabric 80' is mounted in the main frame 10' and has an outer peripheral edge connected to the sleeve 12' of the main frame 10'. The canopy 20' and the upper tent fabric 80' surround a closed room. An area of the upper tent fabric 80' is substantially equal to the area surrounded by the main frame 10'. Thus, the playhouse can be expanded like a dome. With further reference to FIGS. 12 and 13, when the roof supporting frames 30' are inclined, the roof supporting frames 30' and the main frame 10' can be twisted into a figure of an "8" and then folded into a small size.

The playhouse as described has the following advantages. With the roof supporting frames 30, 30A, 30' propping up the top tent fabric 22 into a dome, with the main spring wire 11 of the main frame 10, 10' and the bottom spring wire 41 of the bottom frame 40 expanding the upper tent fabric 80' and the bottom tent fabric into planes, and with the supporting assemblies 70 that are easy to be disassembled and assembled expanding the side tent fabric 50, the playhouse in accordance with the present invention can be constructed into a three-dimensional space and does not collapse while the children are bumping into the playhouse. Thus, the playhouse is safe for use.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A playhouse comprising:

a main frame having:

a main spring wire, with the main spring wire being circular; and a sleeve wrapped around the main spring wire;

a canopy mounted on and above the main frame and having a top tent fabric having an outer peripheral edge connected to the sleeve of the main frame;

two roof supporting frames mounted on the main frame, with each roof supporting frame being longer than a diameter of the main frame and having:

a resilient support, with the resilient support being an elongated arc; and a sleeve wrapped around the resilient support, being longer than the resilient support and having two ends connected to the sleeve of the main frame;

wherein an area of the top tent fabric is larger than an area surrounded by the main frame;

a bottom frame mounted below the main frame, being separate from the main frame and having:

a bottom spring wire, with the bottom spring wire being circular; and a sleeve wrapped around the bottom spring wire;

a side tent fabric mounted between and arranged around the main frame and the bottom frame, and having:

an upper peripheral edge connected to the sleeve of the main frame; and a lower peripheral edge connected to the sleeve of the bottom frame;

a bottom tent fabric mounted in the bottom frame and having an outer peripheral edge connected to the sleeve of the bottom frame; and multiple supporting assemblies longitudinally mounted separately on and arranged around the side tent fabric, with each supporting assembly having:

two side supports separately arranged longitudinally on the side tent fabric, with each side support having:

a fixing end securely attached to the side tent fabric; and a connecting end corresponding to the connecting end of the other side support; and a connector disposed between the connecting ends of the side supports and having two opposite ends and two slots respectively formed in the ends of the connector, with each slot selectively receiving the connecting end of a corresponding side support;

wherein an area of the bottom tent fabric is equal to an area surrounded by the bottom frame.

2. The playhouse as claimed in claim 1 further comprising an upper tent fabric mounted in the main frame and having an outer peripheral edge connected to the sleeve of the main frame;

wherein an area of the upper tent fabric is equal to the area surrounded by the main frame.

3. The playhouse as claimed in claim 2, wherein the canopy further has:

a top spring wire mounted on an inner surface of the top tent fabric and disposed on a center of the top tent fabric;

a covering sheet securely mounted on the inner surface of the top tent fabric and covering the top spring wire; and a fastener mounted on the covering sheet; and wherein each roof supporting frame further has a fastener mounted on the sleeve of the roof supporting frame and selectively attached to the fastener of the canopy.

4. The playhouse as claimed in claim 2, wherein each supporting assembly further has at least one extending strip mounted between the side supports, and wherein each of the at least one extending strip has:

a fixing end securely attached to one side support; and a connecting end extending above and selectively attached to the other side support.

5. The playhouse as claimed in claim 4, wherein each supporting assembly further has multiple pairs of fasteners mounted between the connecting end of the at least one extending strip and the side support that corresponds to the connecting end of the at least one extending strip to connect the at least one extending strip and the side support, and between the side tent fabric and the side supports to connect the side tent fabric and the side supports.

6. The playhouse as claimed in claim 5, wherein each pair of fasteners comprises a hook fastener and a loop fastener.

7. The playhouse as claimed in claim 6, wherein each side support further has:

a supporting bracket being rigid; and a sleeve wrapped around the supporting bracket.

8. The playhouse as claimed in claim 1, wherein the canopy further has:

a top spring wire mounted on an inner surface of the top tent fabric and disposed on a center of the top tent fabric;

a covering sheet securely mounted on the inner surface of the top tent fabric and covering the top spring wire; and a fastener mounted on the covering sheet; and wherein each roof supporting frame further has a fastener mounted on the sleeve of the roof supporting frame and selectively attached to the fastener of the canopy.

9. The playhouse as claimed in claim 1, wherein each supporting assembly further has at least one extending strip mounted between the side supports, and wherein each of the at least one extending strip has:

a fixing end securely attached to one side support; and a connecting end extending above and selectively attached to the other side support.

10. The playhouse as claimed in claim 9, wherein each supporting assembly further has multiple pairs of fasteners mounted between the connecting end of the at least one extending strip and the side support that corresponds to the connecting end of the at least one extending strip to connect the at least one extending strip and the side support, and between the side tent fabric and the side supports to connect the side tent fabric and the side supports.

11. The playhouse as claimed in claim 10, wherein each pair of fasteners comprises a hook fastener and a loop fastener.

12. The playhouse as claimed in claim 11, wherein each side support further has:

a supporting bracket being rigid; and a sleeve wrapped around the supporting bracket.

13. A playhouse comprising:

a main frame having:

a main spring wire, with the main spring wire being circular; and a sleeve wrapped around the main spring wire;

a canopy mounted on and above the main frame and having a top tent fabric having an outer peripheral edge connected to the sleeve of the main frame; and two roof supporting frames mounted on the main frame, with each roof supporting frame being longer than a diameter of the main frame and having:

a resilient support, with the resilient support being an elongated arc; and a sleeve wrapped around the resilient support, being longer than the resilient support and having two ends connected to the sleeve of the main frame;

wherein an area of the top tent fabric is larger than an area surrounded by the main frame, wherein the canopy further has:

a top spring wire mounted on an inner surface of the top tent fabric and disposed on a center of the top tent fabric;

a covering sheet securely mounted on the inner surface of the top tent fabric and covering the top spring wire; and a fastener mounted on the covering sheet; and wherein each roof supporting frame further has a fastener mounted on the sleeve of the roof supporting frame and selectively attached to the fastener of the canopy.

14. The playhouse as claimed in claim 13 further comprising an upper tent fabric mounted in the main frame and having an outer peripheral edge connected to the sleeve of the main frame;

wherein an area of the upper tent fabric is equal to the area surrounded by the main frame.

15. A playhouse comprising:

a main frame having:

a main spring wire, with the main spring wire being circular; and a sleeve wrapped around the main spring wire;

a canopy mounted on and above the main frame and having a top tent fabric having an outer peripheral edge connected to the sleeve of the main frame;

two roof supporting frames mounted on the main frame, with each roof supporting frame being longer than a diameter of the main frame and having:

a resilient support, with the resilient support being an elongated arc; and a sleeve wrapped around the resilient support, being longer than the resilient support and having two ends connected to the sleeve of the main frame;

wherein an area of the top tent fabric is larger than an area surrounded by the main frame; and an upper tent fabric mounted in the main frame and having an outer peripheral edge connected to the sleeve of the main frame;

wherein an area of the upper tent fabric is equal to the area surrounded by the main frame, wherein the canopy further has:

a top spring wire mounted on an inner surface of the top tent fabric and disposed on a center of the top tent fabric;

a covering sheet securely mounted on the inner surface of the top tent fabric and covering the top spring wire; and a fastener mounted on the covering sheet; and wherein each roof supporting frame further has a fastener mounted on the sleeve of the roof supporting frame and selectively attached to the fastener of the canopy.

* * * * *